US011950673B2

(12) United States Patent
Bouchar

(10) Patent No.: US 11,950,673 B2
(45) Date of Patent: Apr. 9, 2024

(54) HEATED HAIR STRAIGHTENING IRON BRUSH

(71) Applicant: Albert Bouchar, Sterling Heights, MI (US)

(72) Inventor: Albert Bouchar, Sterling Heights, MI (US)

( * ) Notice: Subject to any disclaimer, the term of this patent is extended or adjusted under 35 U.S.C. 154(b) by 928 days.

(21) Appl. No.: 16/898,929

(22) Filed: Jun. 11, 2020

(65) Prior Publication Data

US 2020/0397111 A1 Dec. 24, 2020

Related U.S. Application Data

(60) Provisional application No. 62/864,777, filed on Jun. 21, 2019.

(51) Int. Cl.

| | |
|---|---|
| ***A45D 2/00*** | (2006.01) |
| ***A46B 9/02*** | (2006.01) |
| ***A46B 15/00*** | (2006.01) |

(52) U.S. Cl.

CPC ..... *A45D 2/002* (2013.01); *A46B 9/023* (2013.01); *A46B 15/003* (2013.01); *A46B 2200/104* (2013.01)

(58) Field of Classification Search

CPC ..... A46B 9/023; A46B 13/00; A46B 15/003; A46B 2200/104; A45D 2/002; A45D 24/00; A45D 24/16

USPC .... 15/159.1, 160; 132/118, 119.1, 120, 142, 132/226, 229, 238, 269, 271

See application file for complete search history.

(56) References Cited

U.S. PATENT DOCUMENTS

| | | | | |
|---|---|---|---|---|
| 4,217,915 | A * | 8/1980 | Gress | A46B 3/005 132/118 |
| D263,085 | S * | 2/1982 | Andis | D28/35 |
| 4,358,660 | A * | 11/1982 | Andis | A45D 1/18 219/544 |
| 4,368,376 | A * | 1/1983 | Andis | A45D 1/18 132/229 |
| 5,337,765 | A * | 8/1994 | Wong | A45D 19/026 132/142 |
| 5,479,951 | A | 1/1996 | Denebeim | |
| 6,647,582 | B1 * | 11/2003 | Rechelbacher | A46B 5/02 15/160 |
| 8,341,794 | B1 * | 1/2013 | Sales | B08B 9/021 15/160 |
| 8,573,231 | B2 * | 11/2013 | Ragosta | A45D 20/50 15/23 |
| 9,414,661 | B2 * | 8/2016 | Keong | A46B 9/023 |
| 10,028,574 | B2 | 7/2018 | Rennette | |
| 2008/0201979 | A1 | 8/2008 | Rhoades | |
| 2014/0123422 | A1 * | 5/2014 | Boyd | E04H 4/1609 15/160 |

FOREIGN PATENT DOCUMENTS

KR 100729274 B1 6/2007

* cited by examiner

*Primary Examiner* — Randall E Chin

(74) *Attorney, Agent, or Firm* — Young Basile Hanlon & MacFarlane, P.C.

(57) ABSTRACT

A hair brush comprising: (a) a handle; (b) a brush body having: (i) a first side; (ii) a second side; (iii) a third side; and (iv) a fourth side that are connected together forming a substantially square shape; and (c) bristles located in a row along each of the first side, the second side, the third side, and the fourth side.

20 Claims, 15 Drawing Sheets

HEATED HAIR STRAIGHTENING IRON BRUSH

CROSS-REFERENCE TO RELATED APPLICATION

This application claims priority to U.S. Provisional Patent Application No. 62/864,777, filed Jun. 21, 2019, which is incorporated herein in its entirety by reference

TECHNICAL FIELD

This disclosure relates to hair brushes and particularly to heated hair iron brushes.

BACKGROUND

Typical hair styling devices such as non-heated hair brushes, hot hair brushes, hair irons, and combination blow dryer/hair brushes are ineffective for straightening and styling hair, especially thick hair. Such devices often include curved surfaces or bristles attached to curved surfaces which contact a user's hair. These curved configurations often produce curve or curl in the hair, which is undesirable in scenarios where the user desires the hair to be straightened. Typical devices designed to straighten hair, such as paddle brushes or flat hair irons, are time consuming to use and lack the capability to both straighten and curve and/or curl hair using the same device. Such devices also lack the capability to separate, heat, and straighten hair simultaneously.

SUMMARY

The present teachings provide: a hair brush comprising: (a) a handle; (b) a brush body having: (i) a first side; (ii) a second side; (iii) a third side; and (iv) a fourth side that are connected together forming a substantially square shape; and (c) bristles located in a row along each of the first side, the second side, the third side, and the fourth side.

A hair brush comprising: (a) a handle; (b) a brush body having: (i) a first side; (ii) a second side; (iii) a third side; (iv) a fourth side that are connected together forming a substantially square shape; (v) an arm; (vi) a side of the brush body connected to and extending from the arm, the side of the brush body extending along two sides of the brush body; and (vii) a space located between two arms; (c) a coupler that connects the handle to the brush body; (d) bristles; and (e) inserts including bristles having rows, the inserts being located in the space on the first side, the second side, the third side, and the fourth side.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Described herein are devices for straightening and/or styling a user's hair, including heated hair straightening iron brushes, also referred to as hair brushes. The disclosed hair brushes include a brush head having bristles, a heating element for heating the brush head and bristles, and a handle attached to the brush head for manipulating the brush head through hair. The brush head includes flat sides with bristles located on each side. For example, the hair brush may include four sides (i.e., a first side, second side, third side, and a fourth side). The flat shape of the sides of the brush head and the heat emitted by the brush body via the heating element efficiently straighten hair while the hair brush is pulled through the user's hair. Further, the heated bristles attached to each side of the brush head pull the user's hair into contact with the flat sides of the brush head and separate the user's hair to more efficiently apply heat and straighten the hair. The user may also use bristles located on multiple sides of the brush body to style curves, curls, or angles into the user's hair. In this manner the user may selectively straighten, curve, angle, or curl hair using the same hair brush.

Figure 1:
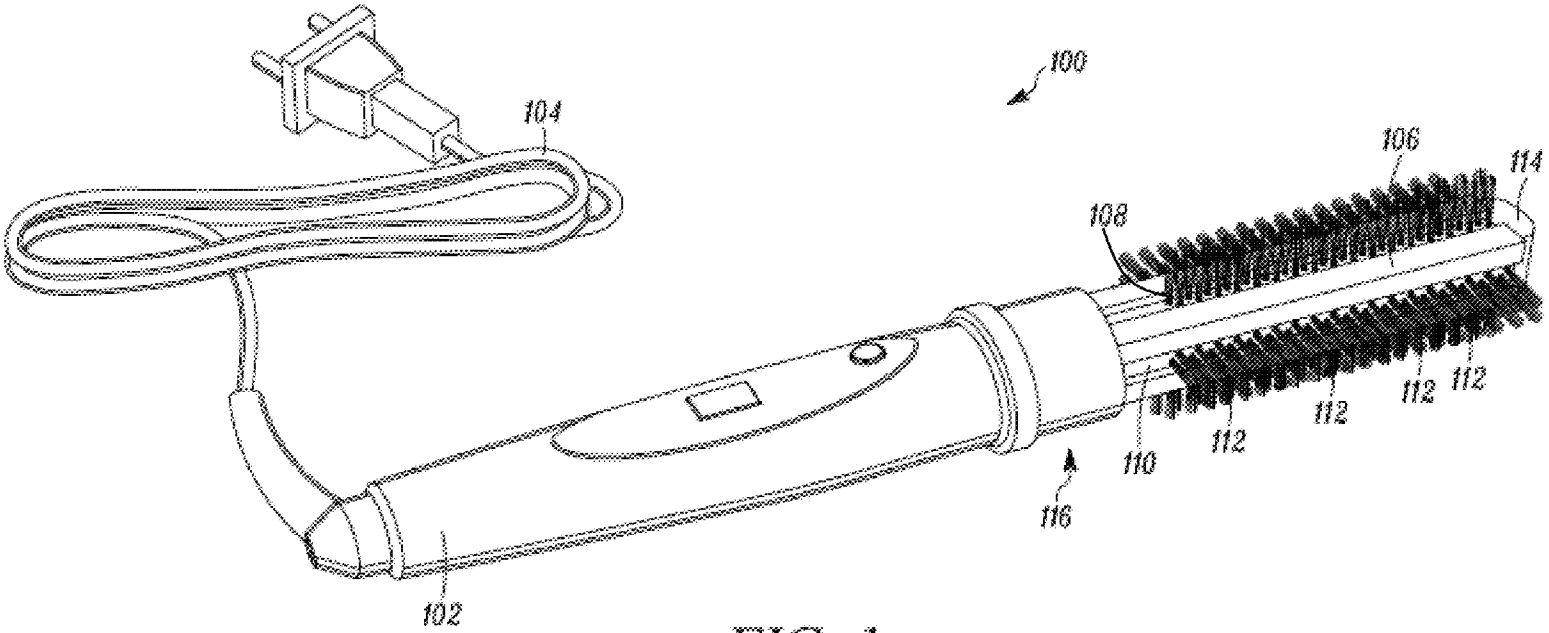
FIG. 1 is a top perspective view of a hair brush.

FIG. 1 is a top perspective view of a hair brush 100 according to one embodiment. The hair brush 100 may include a handle 102, an electrical connector 104, a brush body 106, first bristle inserts 108, second bristle inserts 110, bristles 112, an end cap 114, and a coupler 116. The hair brush may have one or more rows of bristles on each side of the hair brush. The hair brush may have 2, 3, 4, 5, or even 6 sides. Preferably, the hair brush has four sides. Each of the sides may have one row or more, two rows or more, or even three rows or more of bristles. Each side may have six rows or less, five rows or less, or four rows or less. Each row of bristles may be continuous bristles or groups of bristles. For example, the bristles may be a continuous line of bristles without spacing. Each row of bristles may be parallel to one another. Each bristle or group of bristles may be located next to an opposing bristle. The rows of bristles may have bristles or groups of bristles alternating one another. The bristles or groups of bristles may be spaced apart. The bristles may be plastic bristles, synthetic, fiber, nylon, boar bristles, horsehair, goat hair, or a combination thereof. The bristles may be a single bristle. The group of bristles may include about 5 bristles or more, about 10 bristles or more, about 15 bristles or more, about 20 bristles or more, or about 25 bristles or more each located in a tight proximity (e.g., a same hole). The group of bristles may include about 100 bristles or less, about 75 bristles or less, about 50 bristles or less, or about 40 bristles or less. Each row may include about 10 or more, about 12 or more, about 15 or more, about 17 or more, or about 20 or more bristles or groups of bristles. Each row may include about 50 or less, about 40 or less, about 30 or less, or about 25 or less bristles or groups of bristles. The amount and spacing for the bristles may depend upon a diameter of the bristles. For example, a brush having bristles with a diameter of about 1 mm may include about 20 bristles per row and bristles with a dimeter of about 0.01 mm may have about 200 bristles per row. The rows may point in different directions. The rows may be located an angle apart. The rows may be located about 45 degrees or more, about 60 degrees or more, or about 75 degrees or more apart (e.g., about 90 degrees). The rows may be located about 135 degrees or less, about 115 degrees or less, about 105 degrees or less, or about 90 degrees or less apart.

Figure 2:
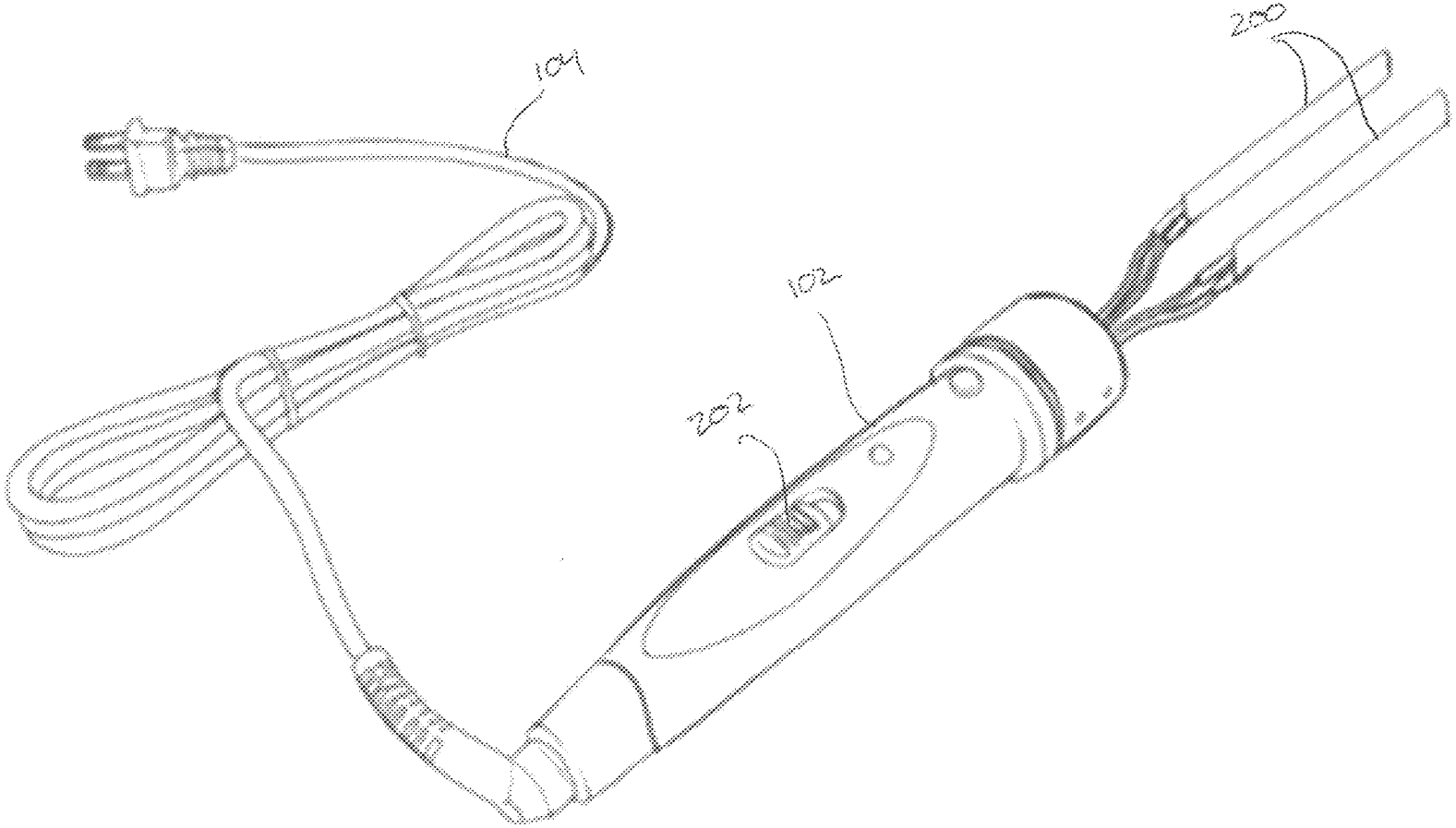
FIG. 2 is a top perspective view of a handle.

FIG. 2 is a top perspective view of the handle 102 and the electrical connector 104. The handle 102 may be an elongate, substantially cylindrical member configured to be grasped by the user. The handle 102 may be made of any plastic or any other suitable material. In other embodiments, the handle 102 may include any other shape. The handle 102 may include a heating element 200 attached to an interior of the handle 102. The heating element 200 may extend from a distal end of the handle 102. The heating element 200 may be configured to receive power from the electric connector 104 and generate heat up to 500 degrees Fahrenheit. At this temperature, the hair brush 100 may effectively heat the user's hair so that it can be efficiently straightened and/or styled. The heating element as discussed herein may heat the hair brush to a temperature of about 350° F. or more, about 400° F. or more, about 450° F. or more, about 475° F. or more, or about 500° F. or more. The heating element may heat the hair brush to a temperature of about 700° F. or less, about 650° F. or less, about 600° F. or less, or about 550° F. or less (±25° F.). This temperature is also effective for straightening thick hair. The heating element 200 may be electrically connected to the electric connector 104. The electric connector 104 may include a plug or any other suitable device configured to receive power from a power source (e.g. a wall outlet). The electric connector 104 may be attached to a proximate end of the handle 102. In other embodiments, the hair brush 100 may not include the electric connector 104 and may include one or more rechargeable batteries configured to supply power to the heating element 200.

The handle 102 may include a switch 202 for activating and deactivating the heating element 200. The handle 102 may include a display (e.g. display screen) configured to display a temperature of the heating element 200, the bristles 112, and/or the brush body 106. The handle 102 may include one or more indicator lights configured to indicate whether the heating element 200 is on, whether the hair brush 100 is receiving power, whether the temperature of heating element 200 is above a predetermined temperature, and/or whether the temperature of the heating element 200 has reached a maximum temperature. The handle 102 may include a temperature control configured to control the temperature of the heating element 200. The temperature control may include any button, wheel, dial, touch screen display, or the like. The hair brush 100 may include a controller in electrical communication with the switch 202, the heating element 200, the indicator lights, the display, and/or the temperature control. The controller may be configured to control operation of any of these components.

Figure 3A:
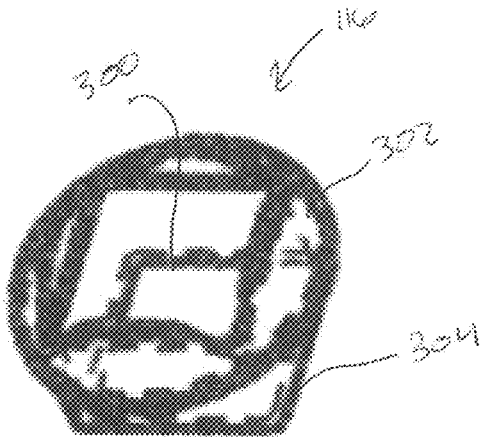
FIG. 3A is a top perspective view of a coupler.
Figure 3B:
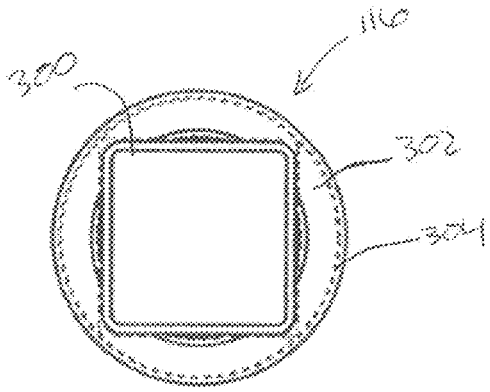
FIG. 3B is a top view of the coupler.
Figure 3C:
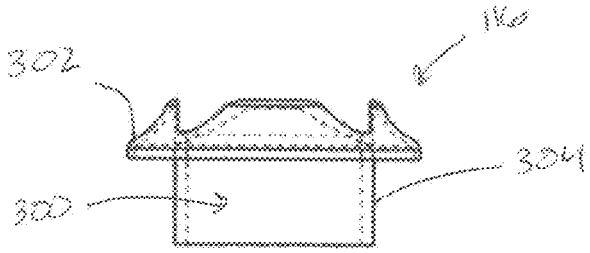
FIG. 3C is a side view of the coupler.

FIG. 3A is a top perspective view of the coupler 116. FIG. 3B is a top view of the coupler 116. FIG. 3C is a side view of the coupler 116. The coupler 116 may attach the handle 102 to the brush body 106. The coupler 116 may include a top portion 302 and a bottom portion 304. The coupler 116 may be made of plastic or any other suitable material. The coupler 116 may include an aperture 300 through the top portion 302 and the bottom portion 304 of the coupler 116. An interior profile of the aperture 300 may be shaped to correspond with an exterior profile of the brush body 106 such that a portion of the brush body 106 may be attached to the coupler 116 inside of the aperture 300. The aperture 300 may also be shaped such that the heating element 200 extends through the aperture 300. The interior profile of the aperture 300 may be square, rectangular, or any other shape. The aperture 300 may include a width of one inch or any other width. The coupler 116 may be attached to the brush body 106 using chemical bonding, interference fit, fasteners, or any other means of attachment.

The bottom portion 304 may include an exterior profile shaped to correspond with an interior profile of an aperture (not shown) located on the distal end of the handle 102. In this configuration, the bottom portion 304 of the coupler 116 may be attached to the interior of the handle 102. In other embodiments, the bottom portion 304 may include an interior profile shaped to correspond with an exterior profile of the distal end of the handle 102. In this configuration, a portion of the handle 102 is located inside the coupler 116. The bottom portion 304 may be attached to the handle 102 using chemical bonding, interference fit, fasteners, or any other means of attachment. The cross-sectional shape of the bottom portion 304 may be square, rectangular, or any other shape. The bottom portion 304 may include a width of 0.5-1.5 inches, or any other width. For example, the bottom portion 304 may include a width of 1.03 inches.

The top portion 302 of the coupler 116 may be attached to or integral with the bottom portion 304. The height of the coupler 116 including the top portion 302 and the bottom portion 304 may be 0.5-1.0 inches or any other height. For example, the height of the coupler 116 may be inches. The top portion 302 may include a width greater than the width of the bottom portion 304. For example, the top portion 302 may include a circular shape where the diameter of the top portion 302 is greater than the width of the bottom portion 304. In other embodiments, the top portion 302 may include any other shape. A bottom surface of the top portion 302 may be attached to and/or adjacent to the distal end of the handle 102.

Figure 4A:
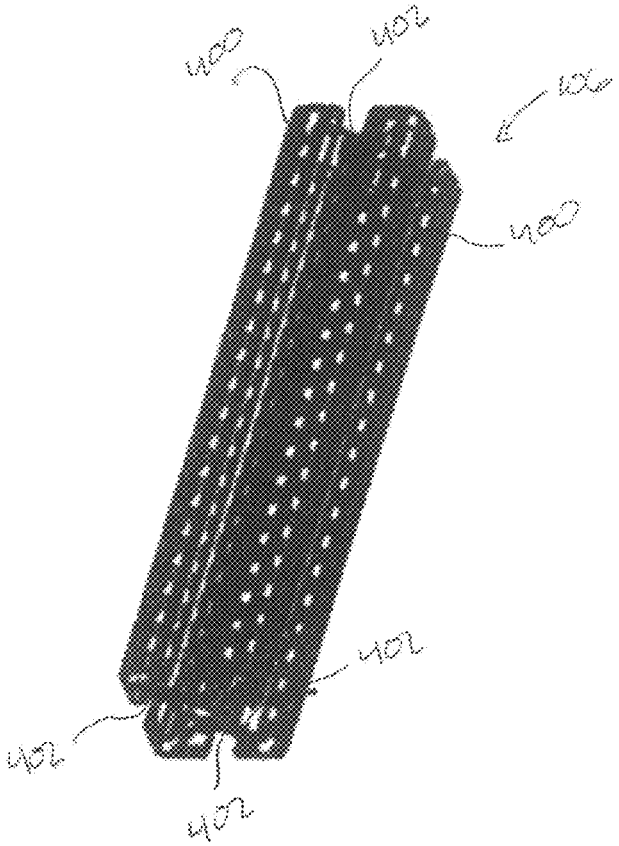
FIG. 4A is a top perspective view of a brush body.
Figure 4B:
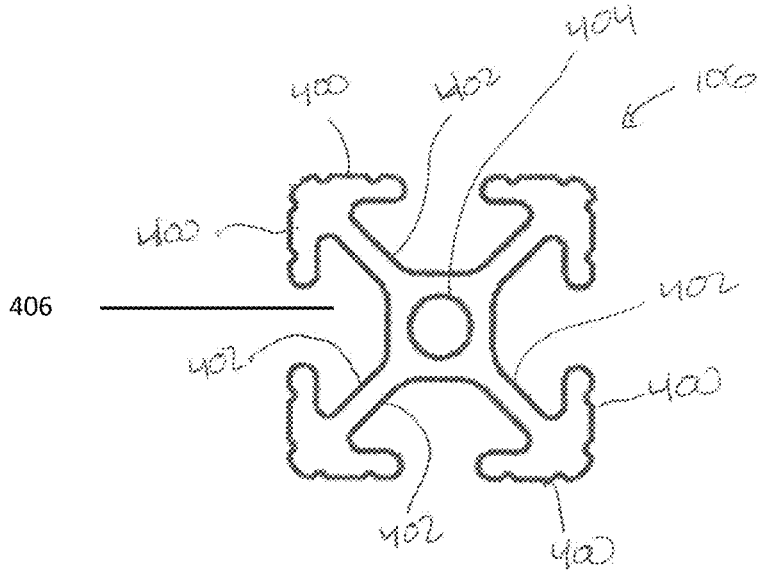
FIG. 4B is a top view of the brush body.
Figure 4C:
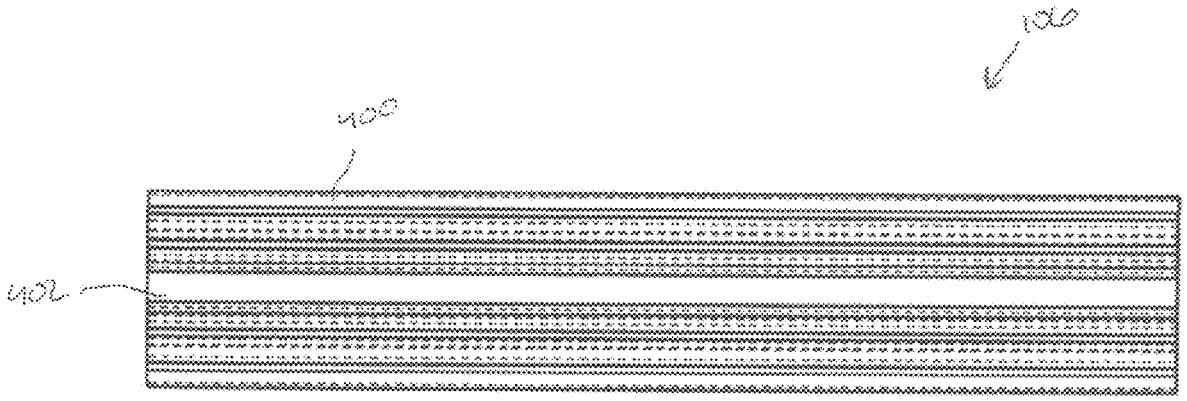
FIG. 4C is a side view of the brush body.

FIG. 4A is a top perspective view of the brush body 106. FIG. 4B is a top view of the brush body 106. FIG. 4C is a side view of the brush body 106. Each side 400 of the brush body 106 may include a portion having a flat surface. In some embodiments, the entirety of each side 400 may form a flat surface. The brush body 106 and/or the sides 400 may conduct heat from the heating element 200 and heat the user's hair. The flat surface on each of the sides 400 may allow the user to flatten the user's hair when the user's hair contacts the flat surface. The brush body 106 may include corners between each of the sides 400. For example, the brush body 106 may include four 90 degree corners. In other embodiments, the brush body 106 may include any number of corners having any other angle. The corners of the brush body may allow the user to style angles in the user's hair when the user's hair contacts one of the corners. A space 406 is located between each of the apertures 404 and sides 400. The sides 400 have an apex and a wall that extend in a first direction and a wall that extends in a second direction away from the apex. The walls extend along two sides of the brush body 106.

A cross-sectional shape of the brush body 106 may include a square, rectangular, triangular, stadium, be symmetrical, be asymmetrical, or any other suitable shape. Each side 400 of the brush body 106 may have a width of one inch or any other width. The sides 400 of the brush body may have equal or unequal widths. The brush body 106 may include a length of 5.0-6.0 inches or any other length. For example, the brush body 106 may include a length of 5.25 inches. Each side 400 of the brush body may include an arm 402. Each arm 402 may be shaped to create a space 406 that receives a bristle insert (described with respect to FIGS. 5-6). For example, each arm 402 may be spaced apart from another arm 402 forming a space 406 that includes an interior profile shaped to correspond with an exterior profile a bristle insert. The brush body 106 may also include an aperture 404 located near the center of the brush. The aperture 404 may have a circular shape or any other shape. The brush body 106 may be made of aluminum or any other material configured to conduct heat from the heating element 200.

Figure 5A:
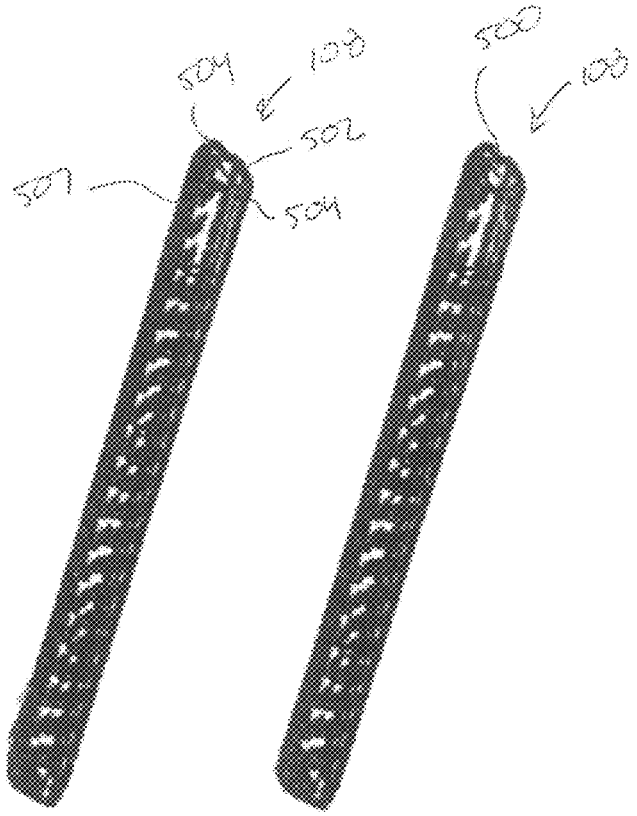
FIG. 5A is a top perspective view of first bristle inserts.
Figure 5B:
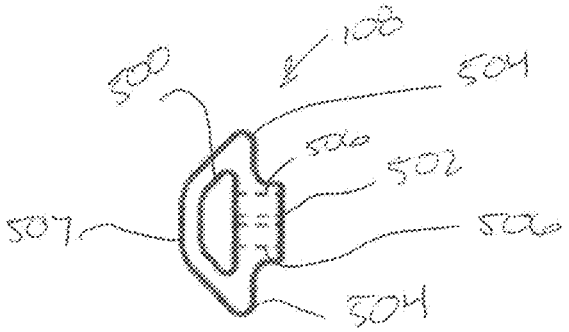
FIG. 5B is a top view of one of the first bristle inserts.
Figure 5C:
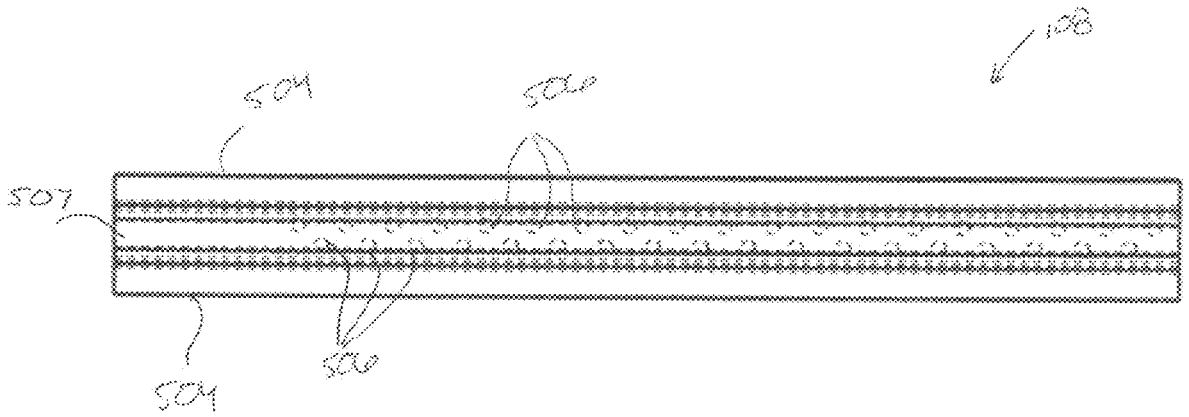
FIG. 5C is a side view of one of the first bristle inserts.

FIG. 5A is a top perspective view of first bristle inserts 108. FIG. 5B is a top view of one of the first bristle inserts 108. FIG. 5C is a side view of one of the first bristle inserts 108. The first bristle inserts 108 are shaped to be received by the space 406 formed between the arms 402 of the brush body 106 of FIGS. 4A-4C. For example, the first bristle inserts may include exterior profiles shaped to correspond with an interior profile of the space 406 between the arms 402. The first bristle inserts 108 may be attached to the brush body 106 inside the space 406 between the arms 402 using chemical bonding, interference fit, fasteners, friction fit, a coupler and cap, a mechanical fastener, or any other means of attachment. The first bristle inserts 108 may be attached to opposing sides of the brush body 106. The first bristle inserts 108 may include an opening 500 extending along a length of the first bristle inserts 108. The first bristle inserts 108 may include a flat portion 502 extending between two flange portions 504. The flat portion 502 may include a width of 0.1-0.5 inches or any other width. For example, the flat portion 502 may include a width of 0.26 inches. The width of each first bristle insert 108 may be 0.25-1.0 inches or any other width. For example, the width of each first bristle insert 108 may be 0.58 inches. The distance from the exterior surface of the flat portion 502 to an opposing exterior surface 507 of the first bristle insert may be 0.1-0.5 inches or any other distance. For example, the distance from the exterior surface of the flat portion 502 to the opposing exterior surface 507 of the first bristle insert may include inches.

The first bristle inserts 108 may include one or more columns of apertures 506 extending from an exterior surface of the first bristle inserts 108 to the opening 500. The apertures 506 may be located on the flat portion 502. For example, the apertures 506 may be located on the flat portion 502 of the first bristle inserts 108 in one or more columns (e.g. two columns), where one column is vertically offset from the adjacent column. In this configuration, the bristles 112 attached to the first bristle inserts 108 inside the apertures 506 can be easily pulled through the user's hair to separate the user's hair into groups of strands and pull the hair into contact with the flat sides of the heated brush body 106. In other embodiments, the first bristle inserts 108 may include the apertures 506 forming any pattern on the first bristle inserts 108. The apertures 506 may be located on any portion of the first bristle inserts 108.

The bristles 112 and apertures 506 may extend along any length and width of the first bristle insert 108. One or more bristles 112 may be attached to the first bristle inserts 108 inside each of the apertures 506. A portion of the bristles 112 may be located inside the opening 500. The bristles 112 may be attached to the first bristle inserts 108 via interference fit, chemical bonding, or any other means of attachment. The first bristle inserts 108 may conduct heat from the heating element 200 or may be made of a thermal insulating material such that he first bristle inserts 108 conduct minimal heat from the heating element 200. The first bristle inserts 108 may be made of any metal (e.g. aluminum), plastic, or any other suitable material. The bristles 112 may conduct heat from the heating element 200 and may be made of any metal (e.g. aluminum, copper, silver, steel), other conductive materials, or any other suitable material. The bristles 112 may have one metal coated with another metal. The bristles 112 may have a resistive material coated with a conductive material or vice versa.

The first bristle inserts 108 may be removeable from the channels 404 of the brush body 106 such that different first bristle inserts 108 having varying characteristics can be inserted in the channels 404. The different first bristle inserts 108 may, for example, be made of different heat conducting or insulating materials, may include a different pattern of apertures 506 and bristles 112, or may include bristles 112 having different lengths or bristles 112 made of different heat conducting or insulating materials.

Figure 6A:
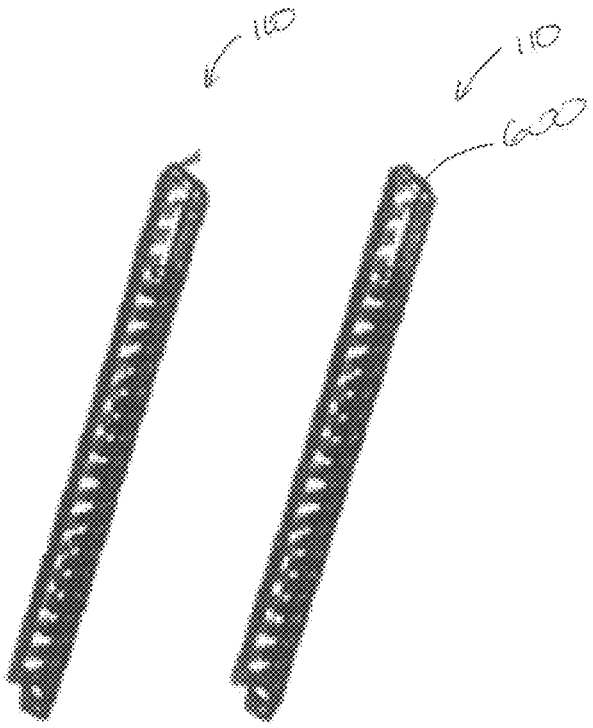
FIG. 6A is a top perspective view of second bristle inserts.
Figure 6B:
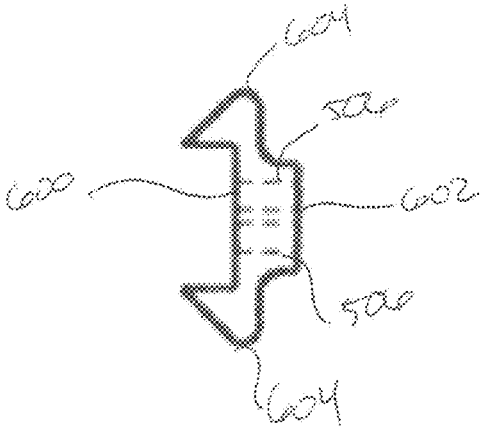
FIG. 6B is a top view of one of the second bristle inserts.
Figure 6C:
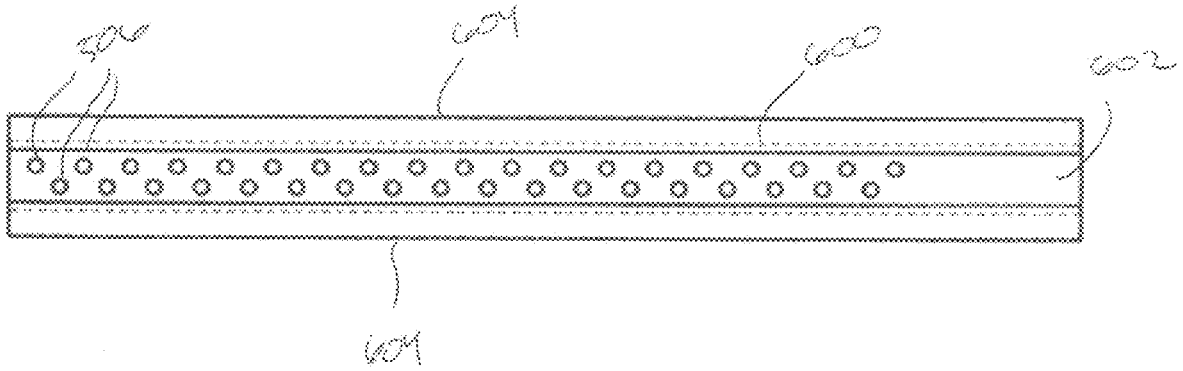
FIG. 6C is a side view of one of the second bristle inserts.

FIG. 6A is a top perspective view of second bristle inserts 110. FIG. 6B is a top view of the second bristle inserts 110. FIG. 6C is a side view of the second bristle inserts 110. The second bristle inserts 110 may include features similar to those of the first bristle inserts 108 except as otherwise described. The second bristle inserts 110 may include a flat portion 602 extending between two flange portions 604. The second bristle inserts 110 may be attached to opposing sides of the brush body 106 that are not attached to the first bristle inserts 108. The second bristle inserts 110 may include heater channels 600 shaped to receive a portion of the heating element 200. For example, the heater channels 600 may include an interior profile shaped to correspond to an exterior profile of a portion of the heating element 200. In this configuration, a portion of the heating element is located inside an interior of the second bristle inserts 110. The width of each heater channel 600 may be 0.1-0.5 inches or any other width. For example, the width of each heater channel 600 may be 0.34 inches. In other embodiments, the heating elements 200 may be attached to any portion of the brush body 106, the first bristle inserts 108, and/or the second bristle inserts 110 in any other manner. The second bristle inserts 110 may include the apertures 506 located on the second bristle inserts 110 as described with respect to the first bristle inserts 108.

The hair brush 100 shown in FIG. 1, the bristles 112 attached to the first bristle inserts 108 and the second bristle inserts 110 extend from a central portion of each of the flat sides of the brush body 106 in a substantially perpendicular direction. A space is defined between the bristles 112 attached to each side of the brush body 106 such that the corners of the brush body 106 are exposed. In this configuration, the bristles 112 may be easily moved through the user's hair while maximum contact is maintained between the hair and the flat sides of the brush body 106. The heated bristles 112 may separate the user's hair into groups of strands and pull the hair into contact with the flat sides of the heated brush body 106 to efficiently straighten and/or style the user's hair. This configuration also allows the user to use bristles 112 attached to multiple sides of the brush body 106 to style the user's hair into curves or curls. The user may also use the corners of the brush body 106 to contact the user's hair to style angles into the user's hair.

Figure 7A:
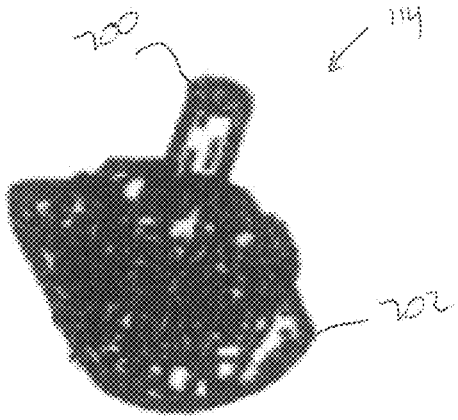
FIG. 7A is a bottom perspective view of an end cap.
Figure 7B:
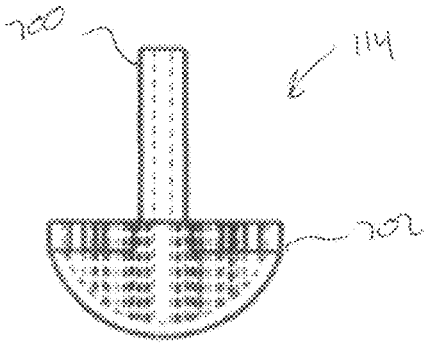
FIG. 7B is a side view of the end cap.
Figure 7C:
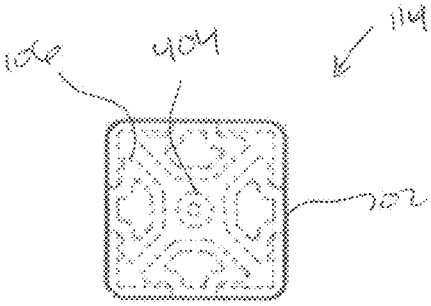
FIG. 7C is a top view of the end cap attached to a top of the brush body.

FIG. 7A is a bottom perspective view of the end cap 114. FIG. 7B is a side view of the end cap 114. FIG. 7C is a top view of the end cap 114 attached to the top of the brush body 106. The end cap 114 may be attached to a top surface of the brush body 106 and/or to top surfaces of the first bristle inserts 108 and the second bristle inserts 110 to retain the first and second bristle inserts inside the channels 404. The end cap 114 may include a bottom portion 700 and a top portion 702. The bottom portion 700 may be shaped to be received in the aperture 404 of the brush body 106. For example, the bottom portion 700 may include an exterior profile shaped to correspond with an interior profile of the aperture 404. The bottom portion may include a cylinder extending away from a bottom surface of the top portion 702 and may be substantially perpendicular to the bottom surface of the top portion 702. In other embodiments, the bottom portion 700 may include any other shape and may extend from the bottom surface of the top portion 702 at any angle. The bottom portion 700 may have a height of 0.5-1.0 inches or any other height. For example, the bottom portion 700 may include a height of 0.75 inches.

The top portion 702 may include a width greater than the bottom portion 700 and may be shaped to be received by a top surface of the brush body 106. For example, the bottom surface of the top portion 702 may include protrusions shaped to be received by the channels 404 in the brush body 106. The cross-sectional shape of the top portion 702 may be square or any other shape. The top portion 702 may have a width of 1 inch, a length of 1 inch, or may have any other length and/or width. The end cap 114 may be made of any plastic or any other suitable material. The end cap 114 may be attached to the brush body 106 and/or the bristle inserts via chemical welding, interference fit, or any other means of attachment. The end cap 114 may be removable from the brush body 106 to allow removal and replacement of the first bristle inserts 108 and/or the second bristle inserts 110.

The end cap 114 may include a body having a recess shaped to receive the distal end of the brush body 106 and the first and second bristle inserts 108, 110. In this configuration, a portion of the brush body 106, the first bristle inserts 108, and the second bristle inserts 110 are located within the recess. In other embodiments, the hair brush 100 may not include the end cap 114 and the first and second bristle inserts 108, 110 may be otherwise attached to the brush body 106.

Figure 8:
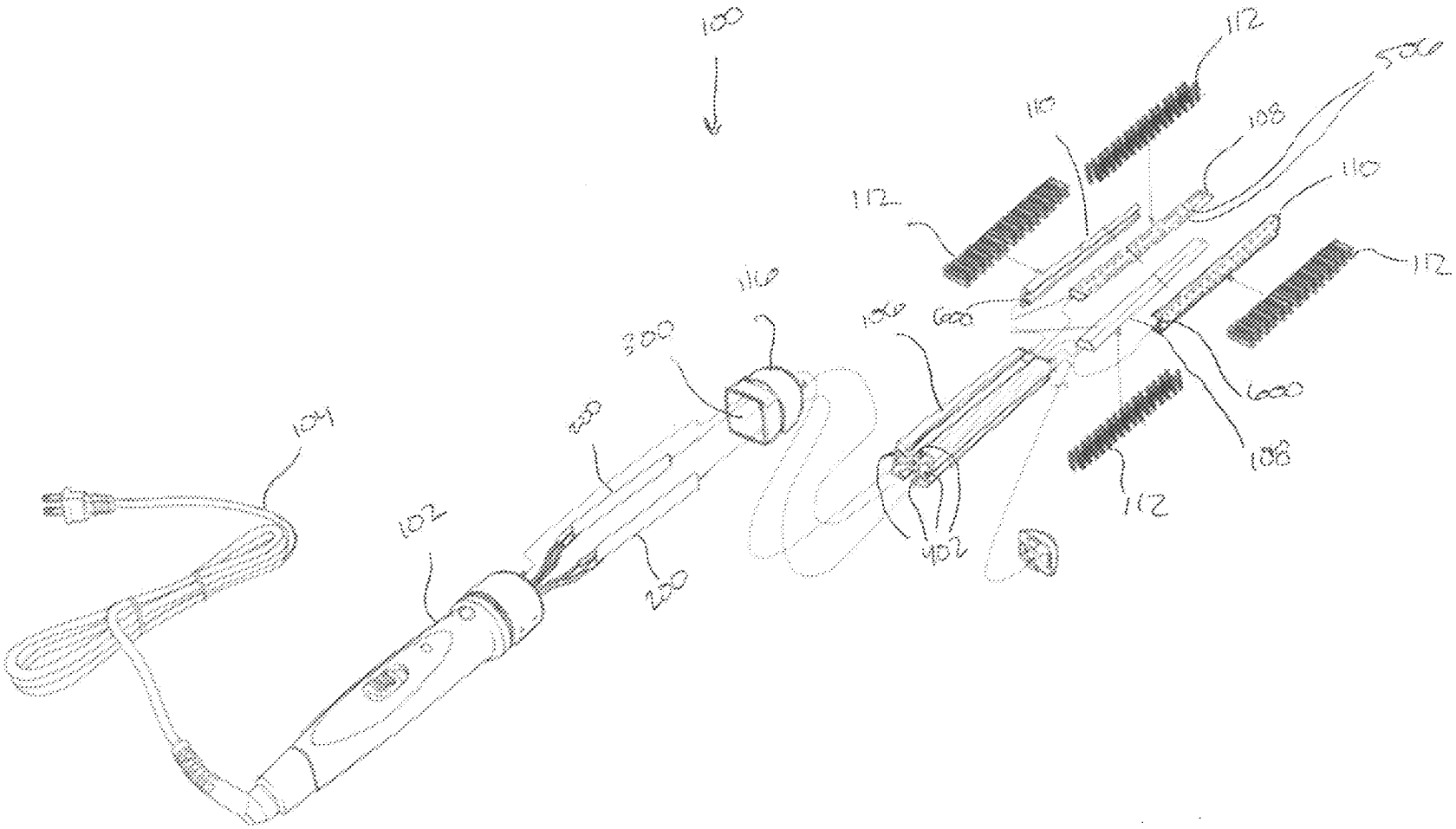
FIG. 8 is an exploded view of the hair brush.

FIG. 8 is an exploded view of the hair brush 100. The electrical connector 104 is attached to the proximate end of the handle 102. The heating element 200 is attached to the distal end of the handle 102. The coupler 116 is attached to the distal end of the handle 102 and to a proximate end of the brush body 106. The first bristle inserts 108 and the second bristle inserts 110 are located in the channels 404 defined by the brush body 106. The heating element 200 extends through the aperture 300 of the coupler 116 and into heater channels 600 defined by the second bristle inserts 110. The bristles 112 are connected to the first and second bristle inserts 108, 110 inside the apertures 506. The end cap 114 is attached to the distal end of the brush body 106 to retain the first and second bristle inserts 108, 110 in the channels 404 defined by the brush body 106.

Figure 9:
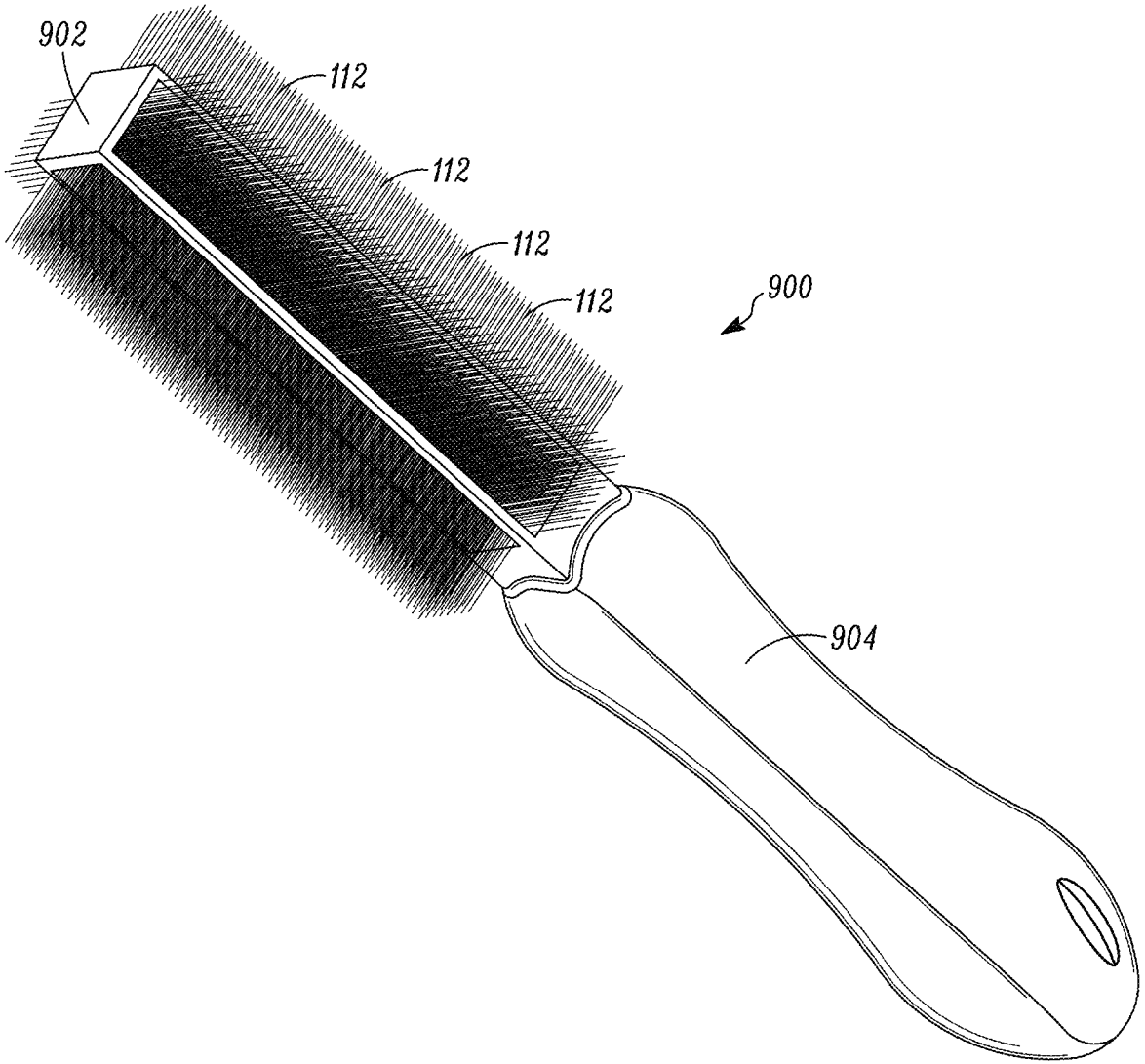
FIG. 9 is a top perspective view of a hair brush.
Figure 10:
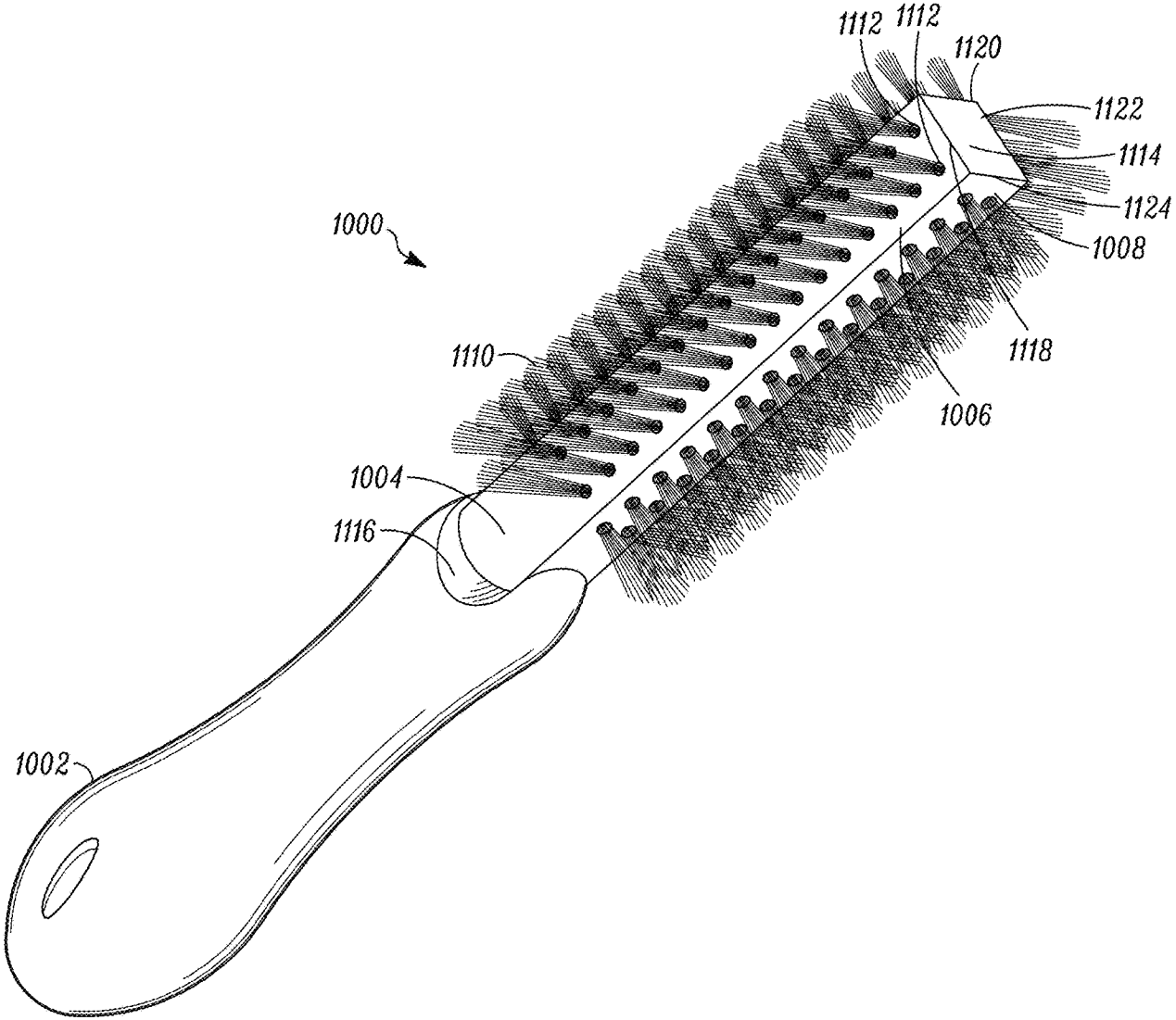
FIG. 10 is a perspective view of a hair brush.

FIG. 9 is a top perspective view of a hair brush 900 according to another embodiment. The hair brush 900 may include features similar to those of hair brush 100 except as otherwise described. A brush body 902 may be attached to a distal end of a handle 904. The brush body 902 may include features similar to those of brush body 106 except as otherwise described. For example, the hair brush 900 may be of generally fixed construction such that the brush body 902 may not include channels and the hair brush 900 may not include an end cap that allows for removal and replacement of the bristle inserts. The brush body 902 may include apertures each shaped to receive one or more bristles 112. The bristles 112 may be attached to the brush body 902 inside the apertures within the brush body. The bristles 112 may extend along substantially the entire length and width of each of the sides of the brush body 902 in a grid pattern. The brush body 902 and the bristles 112 may conduct heat from a heating element (not shown) located in the interior of the brush body 902. FIG. 10 is a perspective view of a hair brush 1000 having a handle 1002 and a brush body 1004. The brush body 1004 has a first bristle insert 1006 and a second bristle insert 1008. Each of the first bristle insert 1006 and the second bristle insert 1008 includes bristles 1110 that are a plurality of groups of bristles 1112. The groups of bristles 1112 are evenly distributed and spaced apart from each other. The brush body 1004 includes an end cap 1114 that assists in retaining the first bristle insert 1006 and the second bristle insert 1008 within the brush body 1004. A coupler 1116 assists in connecting the handle 1002 to the brush body 1004. The brush body 1004 is a square shape and includes a first side 1118, a second side 1120, a third side 1122, and a fourth side 1124. The hair brush 1000 may be free of heat or being heated.

Figure 11:
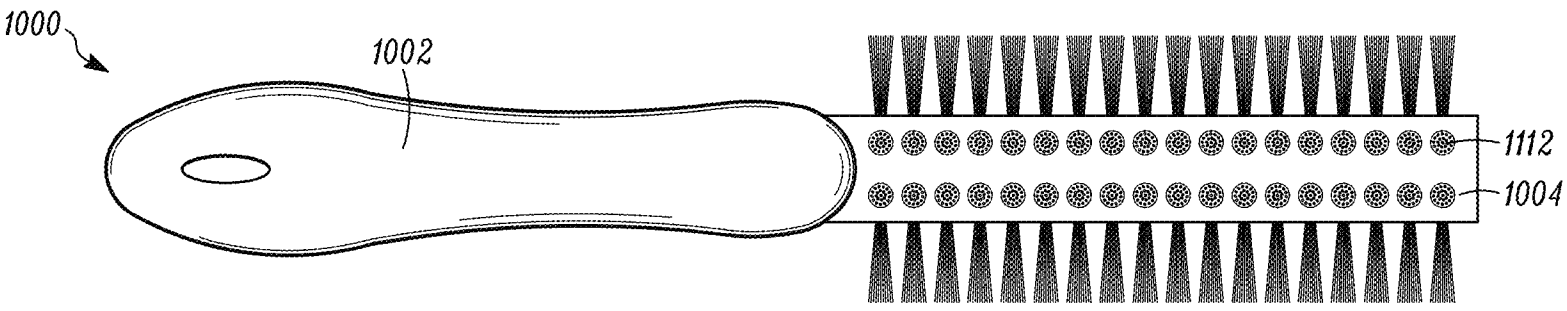
FIG. 11 is a top view of the hair brush of FIG. 10.

FIG. 11 is a top view of the hair brush 1000 of FIG. 10. The hair brush 1000 has a handle 1002 and a brush body 1004 that includes groups of bristles 1112.

Figure 12:
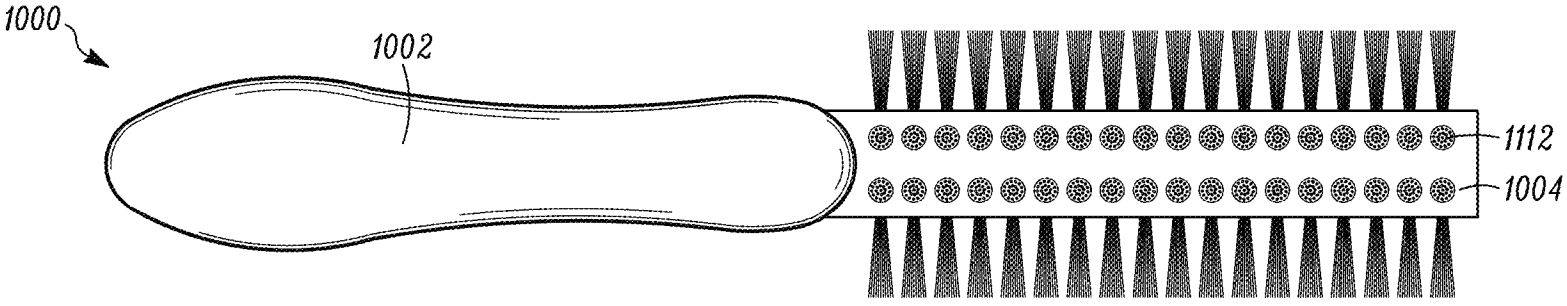
FIG. 12 is a side view of the hair brush of FIG. 10.

FIG. 12 is a top view of the hair brush 1000 of FIG. 10. The hair brush 1000 has a handle 1002 and a brush body 1004 that includes groups of bristles 1112.

Figure 13:
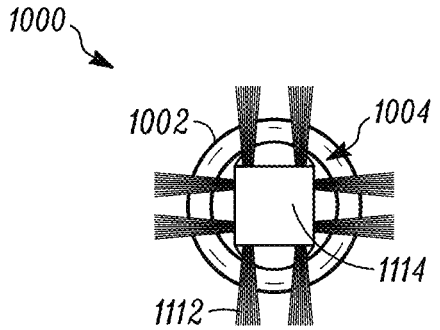
FIG. 13 is a top view of the hair brush of FIG. 10.

FIG. 13 is an end view of the hair brush 1000 of FIG. 10 with a handle 1002 visible below a brush body 1004. The brush body 1004 has an end cap 1114 and groups of bristles 1112 extending from the brush body 1004.

Figure 14:
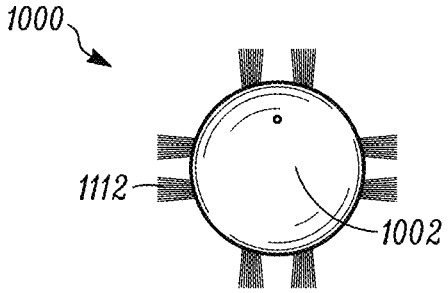
FIG. 14 is a bottom view of the hair brush of FIG. 10

FIG. 14 is an end view of the hair brush 1000 of FIG. 10 showing the handle 1002 and groups of bristles 112 extending outward beyond the handle 1002

Variation 1 may comprise: a hair brush comprising: (a) a handle; (b) a brush body having: (i) a first side; (ii) a second side; (iii) a third side; and (iv) a fourth side that are connected together forming a substantially square shape; and (c) bristles located in a row along each of the first side, the second side, the third side, and the fourth side.

Variation 2 may comprise the hair brush of variation 1 and may include: wherein the rows are two rows.

Variation 3 may comprise the hair brush of variations 1-2 and may include: wherein the bristles are groups of bristles that include ten or more bristles in each of the groups.

Variation 4 may comprise the hair brush of variations 1-3 and may include: wherein the bristles are individual bristles.

Variation 5 may comprise the hair brush of variations 1-4 and may include: wherein the hair brush includes heating elements.

Variation 6 may comprise the hair brush of variations 1-5 or Sand may include: wherein the heating elements are located within the brush body.

Variation 7 may comprise the hair brush of variations 1-6 and may include: wherein the brush body includes a central aperture that extends through a length of the brush body, arms extending away from the central aperture, and sides extending outward from the arms.

Variation 8 may comprise the hair brush of variations 1-7 or 7 and may include: wherein the sides have a "V" shape.

Variation 9 may comprise the hair brush of variations 1-8 or 8 and may include: wherein the sides have an apex with a wall extending in a first direction along a side and a second wall extending in a second direction along a second side.

Variation 10 may comprise the hair brush of variations 1-9 or 9 and may include: wherein a bristle insert extends into a space between the sides and the arms.

Variation 11 may comprise the hair brush of variations 1-10 or 7 and may include: wherein a space is located between two of the arms and the sides and a heating element extends into one or more of the spaces.

Variation 12 may comprise the hair brush of variations 1-11 and may include: comprising an end cap at an end of the brush body.

Variation 13 may comprise the hair brush of variations 1-12 and may include: comprising a coupler that connects the handle to the brush body.

Variation 14 may comprise the hair brush of variations 1-13 or variation 9 and may include: wherein one or more of the bristle inserts include a heater channel and one or more of the bristle inserts are free of a heater channel.

Variation 15 may comprise a hair brush comprising: (a) a handle; (b) a brush body having: (i) a first side; (ii) a second side; (iii) a third side; (iv) a fourth side that are connected together forming a substantially square shape; (v) an arm; (vi) a side of the brush body connected to and extending from the arm, the side of the brush body extending along two sides of the brush body; and (vii) a space located between two arms; (c) a coupler that connects the handle to the brush body; (d) bristles; and (e) inserts including bristles having rows, the inserts being located in the space on the first side, the second side, the third side, and the fourth side.

Variation 16 may comprise the hair brush of variations 1-14 or 15 and may include: wherein the sides of the brush body have a "V" shape.

Variation 17 may comprise the hair brush of variations 1-14 or 15-16 and may include: wherein one or more of the inserts include a heater channel.

Variation 18 may comprise the hair brush of variations 1-14 or 15-17 and may include: wherein the hair brush comprises heating elements one or more of the heating elements extend into the heater channel.

Variation 19 may comprise the hair brush of variations 1-14 or 15-18 and may include: wherein one or more of the inserts are free of a heater channel.

Variation 20 may comprise the hair brush of variations 1-14 or 15-19 and may include: wherein the sides have an apex and having a side that extends in a first direction and a second side extending in a second direction.

The word "example" is used herein to mean serving as an example, instance, or illustration. Any aspect or design described herein as "example" is not necessarily to be construed as preferred or advantageous over other aspects or designs. Rather, use of the word "example" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment or implementation unless described as such.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

100 Hair brush
102 Handle
104 Electrical Connector
106 Brush Body
108 First Bristle Inserts
110 Second Bristle Inserts
112 Bristles
114 End Cap
116 Coupler
200 Heating Element
202 Switch
300 Aperture
302 Top Portion
304 Bottom Portion
400 Side of Brush Body
402 Ann
404 Aperture
406 Space
500 Opening
502 Flat Portion
504 Flange Portion
506 Apertures
507 Opposing Exterior Surface
600 Heater Channels
602 Flat portions
604 Two Flange Portions
700 Bottom Portion
702 Top Portion
900 Hair Brush
902 Brush Body
1000 Hair Brush
1002 Handle
1004 Brush Body
1006 First Bristle Inserts
1008 Second Bristle Inserts
1110 Bristles
1112 Group of Bristles
1114 End Cap
1116 Coupler
1118 First side
1120 Second side
1122 Third side
1124 Fourth side

I claim:

1. A hair brush comprising:

a) a handle;

b) a brush body having:

i) a first side;

ii) a second side;

iii) a third side;

iv) a fourth side that are connected together forming a substantially square shape;

v) a central aperture that extends through a length of the brush body;

vi) arms extending away from the central aperture; and vii) sides extending outward from the arms;

c) bristles located in a rows along each of the first side, the second side, the third side, and the fourth side; and d) one or more bristle inserts comprising:

a heater channel; and wherein the one or more of the bristle inserts are free of the heater channel;

wherein the first side, the second side, the third side, and the fourth side have a "V" shape and an apex with a wall extending in a first direction along a first surface and a second wall extending in a second direction along a second surface of the brush body.

2. The hair brush of claim 1, wherein the rows are two rows.

3. The hair brush of claim 1, wherein the bristles are groups of bristles that include ten or more bristles in each of the groups.

4. The hair brush of claim 1 wherein the bristles are individual bristles.

5. The hair brush of claim 1, wherein the hair brush includes heating elements.

6. The hair brush of claim 5, wherein the heating elements are located within the brush body.

7. The hair brush of claim 1, comprising an end cap at an end of the brush body.

8. The hair brush of claim 1, comprising a coupler that connects the handle to the brush body.

9. A hair brush comprising:

a) a handle;

b) a brush body having:

i) a first side;

ii) a second side;

iii) a third side;

iv) a fourth side that are connected together forming a substantially square shape;

v) arms;

vi) a side of the brush body connected to and extending from the arm, the side of the brush body extending along two sides of the brush body; and vii) a space located between two of the arms;

c) a coupler that connects the handle to the brush body;

d) bristles; and e) inserts comprising:

bristles having rows, the inserts being located in the space located between the two of the arms on the first side, the second side, the third side, and the fourth side and a heater channel.

10. The hair brush of claim 9, wherein the brush body includes a central aperture that extends through a length of the brush body, a first arm, a second arm, a third arm, and a fourth arm extending away from the central aperture, and a first side extending outward from the first arm, a second side extending outward from the second arm, a third side extending outward from the third arm, and a fourth side extending outward from the fourth arm.

11. The hair brush of claim 10, wherein the first side, the second side, the third side, and the fourth side each have a "V" shape.

12. The hair brush of claim 11, wherein the first side, the second side, the third side, and the fourth side each have an apex with a wall extending in a first direction along a side and a second wall extending in a second direction along a second side of the brush body.

13. The hair brush of claim 12, wherein a bristle insert extends into a space between the first side and the first arm, the second side and the second arm, the third side and the third arm, and the fourth side and the fourth arm.

14. The hair brush of claim 10, wherein a space is located between two of the arms on the first side, the second side, the third side, and the fourth side and a heating element extends into one or more of the spaces.

15. The hair brush of claim 12, further comprising: one or more bristle inserts comprising: a heater channel and one or more of the bristle inserts are free of the heater channel.

16. The hair brush of claim 15, comprising a coupler that connects the handle to the brush body.

17. The hair brush of claim 9, wherein the first side, the second side, the third side, and the fourth side of the brush body have a "V" shape.

18. The hair brush of claim 17, wherein the first side, the second side, the third side, and the fourth side each have an apex and having a side that extends in a first direction and a second side extending in a second direction.

19. The hair brush of claim 9, wherein the hair brush comprises one or more of heating elements that extend into the heater channel.

20. The hair brush of claim 9, wherein one or more of the inserts are free of a heater channel.

* * * * *